United States Patent [19]

Bogda et al.

[11] Patent Number: 4,892,983

[45] Date of Patent: Jan. 9, 1990

[54] PROGRAMMER/TIMER WITH COMBINED LINE AND PROGRAM FUNCTION SWITCH

[75] Inventors: Richard C. Bogda, Elmhurst; George D. Georgacakis, Skokie, both of Ill.

[73] Assignee: Eaton Corporation, Cleveland, Ohio

[21] Appl. No.: 281,572

[22] Filed: Dec. 8, 1988

[51] Int. Cl.[4] ..... H01H 43/00

[52] U.S. Cl. ..... 200/38 R; 200/38 A; 200/38 B; 200/38 C

[58] Field of Search ..... 200/38 R, 38 A, 38 F, 200/38 FA, 38 FB, 38 B, 38 BA, 38 C, 38 CA

[56] References Cited

U.S. PATENT DOCUMENTS

| | | | |
|---|---|---|---|
| 3,431,372 | 4/1969 | Obermann | 200/38 A |
| 3,752,944 | 8/1973 | Cartier et al. | 200/38 C |
| 3,866,002 | 2/1975 | Underwood et al. | 200/33 R |
| 4,413,164 | 11/1983 | Obermann et al. | 200/38 R |
| 4,497,985 | 2/1985 | Courter et al. | 200/38 R |
| 4,497,986 | 2/1985 | Zink et al. | 200/38 R |
| 4,560,846 | 12/1985 | Klopp et al. | 200/38 R |

*Primary Examiner*—J. R. Scott
*Attorney, Agent, or Firm*—R. A. Johnston

[57] ABSTRACT

A combination programmer and line switch for an appliance having a rotary program cam and a timing motor connected for advancing the cam. An upper line power contact blade is moved between high and low positions by a manual actuator. A lower contact blade is maintained stationary and is adapted for connection to certain appliance load functions. An intermediate program contact blade series connected to the timing motor has a follower biased against the program cam and is adapted for connection to all appliance functions. With the upper contact in the high position, the motor circuit is open for all positions of the program and in the low position the timing motor is energized. Alternatively, the program cam may include a line contact switch override to maintain the intermedaite blade in contact with the upper blade for both positions of the manual actuator.

7 Claims, 4 Drawing Sheets

PROGRAMMER/TIMER WITH COMBINED LINE AND PROGRAM FUNCTION SWITCH

BACKGROUND OF THE INVENTION

The present invention relates to electrical programmer/timers for appliances and particularly for household appliances such as washing machines, dishwashers and clothes dryers having user selected program intervals. Appliances of this type typically have a knob or dial rotated by the user for selection of the length of the appliance service program. The user rotates the dial to the selected dial position or mark for positioning a rotatable program cam operative to be advanced or rotated by a suitable timing mechanism such as a motorized speed reducer or periodically advanced pawl driving a toothed ratchet connected to the program cam and indexing the cam with each stroke of the pawl for time-out of the selected program interval. The program cam is typically contacted by a plurality of cam followers positioned thereabout for providing a desired sequence of operation to electrical function switches connected to each of the cam followers. The switches typically provide for the desired individual appliance functions such as controlling an electric water inlet valve, a water drain pump or drain valve, or an agitation and spin motor.

Programmer/timers of the above-described type are typically driven by a small subfractional horsepower synchronous timing motor which is connected to the appliance power line connector via a line switch. In some household appliance designs, it has been desired to provide actuation of the appliance line power switch by providing an axial movement to the program knob or dial for actuation of the line switch. Where space is at a premium for packaging the programmer/timer in the appliance control panel housing, the size of the program cam drum is limited, which in turn limits the number and size of cam actuated function or program switches that can be disposed about the cam drum for actuation thereby. It has therefore been desired to integrate the line function switch with the switches actuated by the program cam followers to conserve space and reduce manufacturing cost.

Where the appliance line power switch is combined with cam actuated switching functions, it has been found difficult to provide for separate user-actuation of the line power switch to retain user control of the appliance, and yet also provide for continuing power to the timing motor for advancing the cam to a desired position for restart after all other appliance functions have been disconnected by the power line switch.

It is known to provide an appliance programmer/timer having a rotary program cam for actuating a plurality of function switches wherein the line switch is combined with a program switch and the line switch is actuated by axial movement of the knob shaft for moving a slider to actuate the line switch. An example of such is described in U.S. Pat. No. 3,431,372 in the name of G. Obermann and in U.S. Pat. No. 4,497,985 in the name of Courter etal. However, the aforementioned programmer/timers having a combined program and line function switch do not provide for maintaining power to the timing motor irrespective of the position of the line switch actuator for certain positions of the program cam.

Thus, it has been desired to find a way or means of providing an appliance line switch combined with a cam operated program switch in a programmer/timer having rotary cam drum for actuating program function switches and to maintain power to the timing motor for certain positions of the program cam drum when the line switch is manually opened with the cam drum in such position.

SUMMARY OF THE INVENTION

The present invention provides a programmer/timer for an appliance such as household dishwashers, washing machines and clothes dryers and has a rotary program cam drum with a plurality of cam followers disposed thereabout each operative for actuating a machine function switch in a prescribed sequence as the cam drum is advanced by rotary movement. The cam advancement is provided by a synchronous timing motor connected via a speed reducer mechanism for driving an oscillating pawl which indexes the ratchet wheel connected to the program cam drum.

A line power and program function switch has a user-actuated axially moved cam member for contacting a slider member which is moved radially for actuating an upper line power switch contact blade which is disposed as the uppermost blade in a stack of at least three blades. A program switch contact blade which is the lowest of the stack has a stationary position and is adapted for electrical connection to certain machine functions. An intermediate switch contact blade has a cam follower provided thereon and is moved in response to the program cam for making and breaking a circuit with the upper line contact blade when a line switch actuator cam member is axially moved between the "ON" position and the "OFF" position. The intermediate contact blade is operative to make and break a circuit connection with the lower program blade only in response to movement of the program cam. When the line switch actuator cam is positioned to the "ON" position, the upper contact blade moves downward under self-bias to make contact with the intermediate contact blade to maintain line power to the timing motor and certain machine program functions for all positions of the program cam. In an alternative embodiment, the program cam is provided with sufficient lift in certain positions to maintain the intermediate contact blade against the line power contact blade when the line switch actuator is in the "OFF" position, for maintaining power to the timing motor for said certain positions of the program cam to provide continued timing motor operation for resetting the cam when the line power switch is opened by the appliance user to prevent subsequent restart with the cam in an undesired position.

The present invention thus provides a low cost compact programmer/timer for a household appliance and employs a rotary program cam with a line power switch combined with one of the program switches to provide for maintaining power to the cam advance motor when the program switches are open. The present invention thus provides for line switch and program function switching in a single combined switch start actuated by a single cam track. In the present invention the user also provides line switch actuation by axial movement of a line switch actuator cam connected to the rotary selector knob. Alternatively, axial movement of the line switch actuator cam may be affected by an auxilliary cam which follows a stationery projection when the program cam is rotated to a certain position by the advance mechanism.

DETAILED DESCRIPTION

Figure 1:
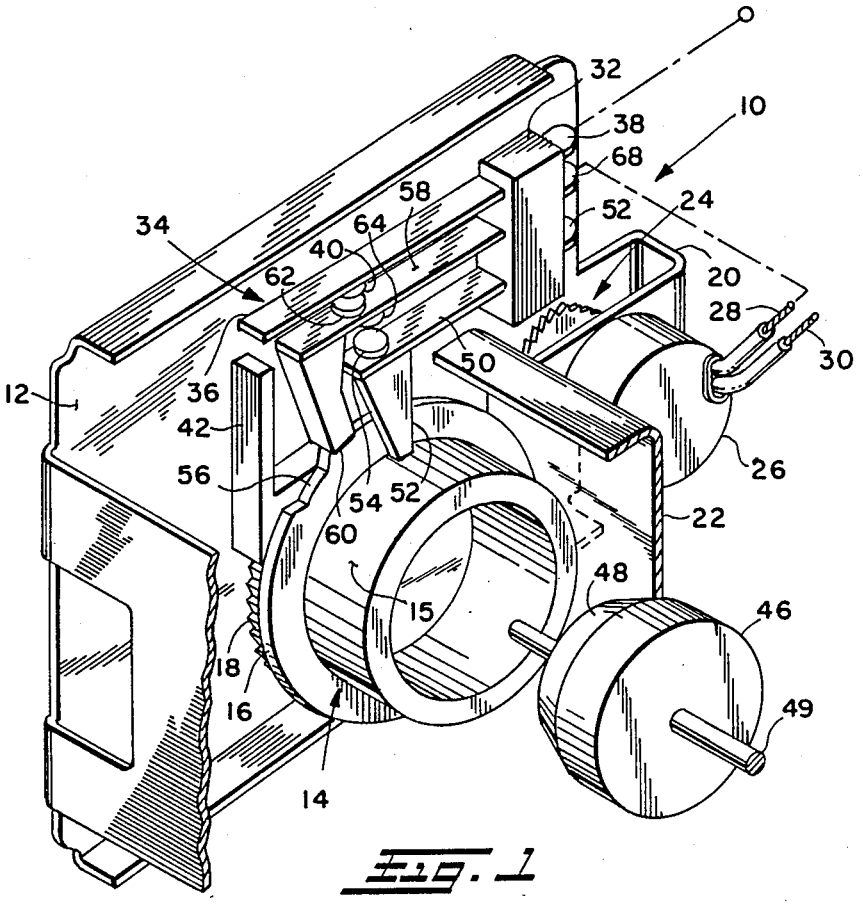
FIG. 1 is a somewhat perspective of the programmer/timer of the present invention with portions of the housing removed.
Figure 2:
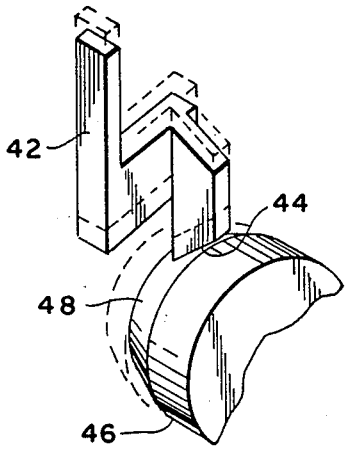
FIG. 2 is an enlarged view of a portion of the line switch actuator of FIG. 1.

Referring to FIGS. 1 and 2, the programmer/timer is indicated generally at 10 and has a housing or deck plate 12 upon which is mounted a program cam 14 journaled on housing 12 and which has thereon a cam track 16 and an advance ratchet wheel having teeth 18 thereon for rotation with the cam 14. Auxiliary support bracket with arms 20, 22 is attached to the deck plate 12 by suitable means as for example, twist-tabs (not shown). A suitable gear reduction indicated generally at 24 is driven by a timing motor 26 mounted on the exterior of bracket arm 20. Motor 26 has its shaft engaging the gear box 24 through bracket arm 20 and the motor 26 has a pair of electrical leads 28, 30 adapted for attachment to a line switch as will hereinafter be described.

The ratchet wheel teeth 18 are driven by an oscillating pawl (not shown) which interconnects the gear box 24 with the ratchet teeth for indexing the cam 14 in a manner well known in the art, the details of which have been omitted for the sake of brevity.

Deck plate 12 has mounted thereon an insulator block 32 which has molded therein and extending outwardly thereform in spaced generally parallel cantilevered relationship a plurality of stacked switch contact blades comprising a combination line and program switch assembly indicated generally at 34. The combination switch has an upper contact blade 36 which extends the furthest distance from block 32 and which has a terminal portion 38 extending through the block 32 and outwardly therefrom for electrical connection to one side of a power line. The line switch contact blade 36 has provided on the lower face thereof a suitable button contact 40 which is adapted for making and breaking a circuit upon movement of the blade 36. Disposed adjacent the lower face of the line switch contact blade 36 near its free end is a line switch actuator 42 which is suitably mounted on deck plate 12 for sliding movement in the vertical direction. Line switch actuator 42 has an inclined cam surface 44 provided thereon which contacts a corresponding surface 48 provided on an axially movable cam member 46. Cam member 46 has a shaft extending therefrom which is received in cam 14 for axially sliding movement therein by the appliance user. Axial movement of cam member 46 is effective to cause movement of line switch actuator 42 from the position shown in solid outline in FIG. 2 to the position shown in dashed outline. It will be understood that shaft 49 although axially moveable is engaged with cam drum 14 for rotation therewith by any suitable means such as a clutch, flats on shaft 49 (not shown) or other technique well known in the art.

A lower program contact blade 50 is mounted in and extends from insulator block 32 in cantilever arrangement with the free end thereof having a follower 52 thereon for contacting a level surface 15 of the cam drum for stationary location with respect to the drum surface as a datum from which the cam track 16 is located. The program blade 50 has an electrical contact 54 disposed on the upper surface thereof with reference to lower program contact blade 50 has a connector portion 52 thereof extending through insulator block 32 and adapted for electrical connection to various desired appliance load functions.

An intermediate program blade 58 is disposed between upper blade 36 and the lower blade 50, the intermediate blade extending in cantilever from insulator block 32 in spaced generally parallel relationship with blades 36 and 50. Intermediate blade 58 has a cam follower 60 provided at the free end thereof which follower is self-biased by the blade 58 to ride on cam track 16. The intermediate blade 58 has an upper contact 62 which is aligned vertically with the contact 40 on the line switch contact blade; and, blade 58 has a lower contact 64 disposed on the undersurface thereof and aligned with the contact 54 on the lower program blade. An electrical connector portion 68 of blade 58 extends through block 32 and externally thereof for connection to motor lead 28 as indicated in FIG. 1 by dashed line.

Rotation of the cam 14 causes the follower 60 to rise and fall in accordance with the contour of the cam track 16 thereby raising and lowering intermediate blade 58 for moving contact 64 between an open and closed position with respect to the lower contact 54 for making and breaking a circuit between the connector terminals 52, 68. It will be understood that upon closure of the contact pair 62, 40 between the intermediate blade and the upper line power contact blade, line power is connected to motor 26.

Referring to FIGS. 1 through 5, the cam drum 14 is shown in a position wherein the cam follower 60 is raised to ride on cam track 16 wherein the intermediate blade 58 is raised and maintained in a position to open the contact set 54, 64 between the intermediate blade 58 and the lower blade 50, thus breaking circuit connections for the selected appliance functions.

Figure 3:
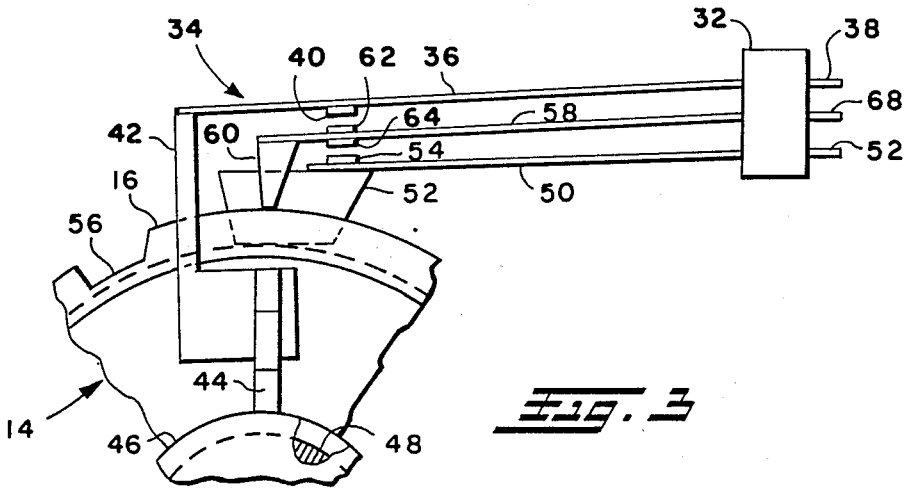
FIG. 3 is a front view of the combined line/program switch of FIG. 1 with the line switch actuator in the "OFF" position and the switches in the open circuit condition.

In FIG. 3, the line switch actuator 42 is shown in the raised or uppermost position limit of its travel wherein the follower 44 is riding on the outer diameter 46 of the actuator member. In the position shown in FIG. 3, the line switch actuator 42 has raised the upper line power contact blade 36 to a position wherein contacts 40, 62 are broken thereby cutting off line power to the timing motor 26 and all other appliance functions. In the condition of switch combinations 34 shown in FIG. 3, the cam drum 14 is immobilized because the timing motor is inactivated.

Figure 4:
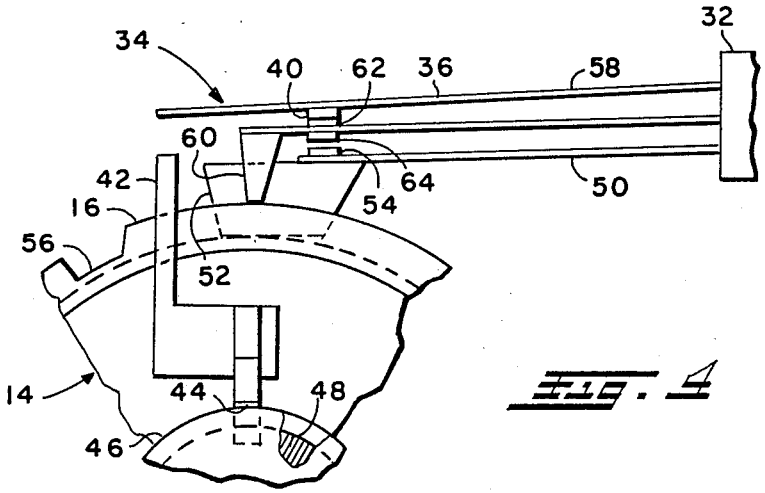
FIG. 4 is a view similar to FIG. 3 with the line switch actuator in the "ON" position, the line switch closed and the program switch open circuit.

Referring to FIG. 4, the switch combination 34 is changed although the cam with same position of FIG. 3 is illustrated, but with the line switch actuator 42 dropped to the lower position wherein the camming surface 44 thereon is released from the outer diameter 46 of the axially movable actuator member to ride on the cam surface 48 (FIG. 2). In the position shown in FIG. 4, the line switch actuator has permitted the upper contact blade 36 to drop under its self-bias until the contact set 40, 62 has closed thereby providing current to flow through contact blade 58 and its connector 68 to the timing motor 26 for continuing advancement of cam 14. In the position shown in FIG. 4, the line switch actuator members 42 and 46 are considered to be in the "ON" position (shown in solid outline in FIG. 2).

Figure 5:
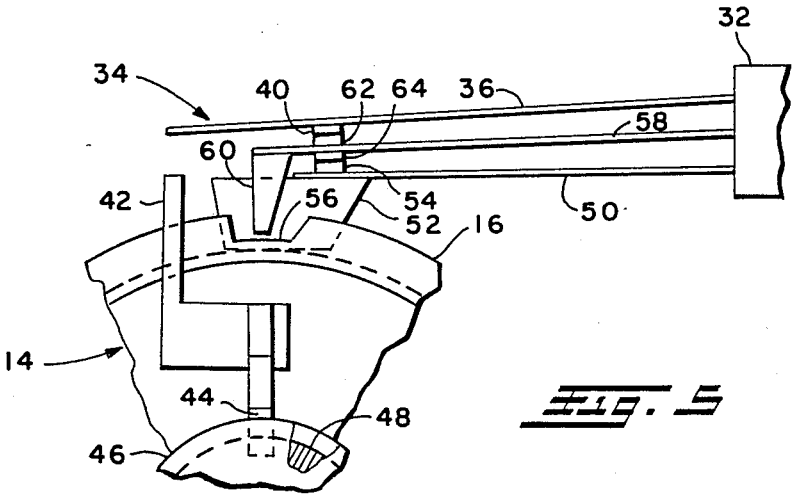
FIG. 5 is a view similar to FIG. 4 with the program cam rotated to a position closing the program switch.

Referring to FIG. 5, switch combination 34 is shown in a condition wherein cam track 16 is no longer beneath follower 60 which has dropped into the depression 56 formed in the cam track 16. In the position shown in FIG. 5, the line switch actuator 42 is maintained in the "ON" position (shown in solid outline in FIG. 2) as in FIG. 4; and, the contact blade 58 has dropped to close the lower set of contacts 64, 54 with and the line power blade self bias maintaining the contact pair 40, 62 closed. In the switch position shown is FIG. 5 both sets of contacts are closed and power is provided to the machine functions through the lower set of contacts and to the timing motors through the upper set of contacts.

Figure 6:
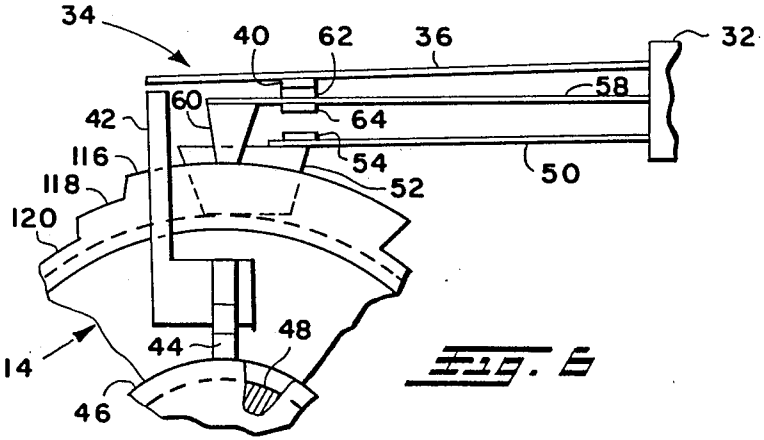
FIG. 6 is a view similar to FIG. 3 and shows the line switch actuator in the "OFF" position with the program maintaining the line switch closed.

Referring to FIGS. 6–11, an alternative embodiment of the programmer cam track 116 is illustrated as having an intermediate step down level 118 and a lower level 120. With reference to FIG. 6, the line switch actuator members 46, 42 are shown in the "OFF" position wherein the cam surface 44 on the actuator 42 is riding on the large diameter 46 of the axially movable actuator member. In the condition of switch combination 34 shown in FIG. 6, cam track surface 116 has raised the cam follower 60 closing contacts 62 40 thereby maintaining power to the timing motor and the lower contact set 64, 54 is broken, thereby terminating current flow to the appliance program functions. Thus, it will be seen that in the switch condition shown in FIG. 6 the cam track 116 maintains power to the timing motor despite the user movement of the line actuator to the "OFF" position.

Figure 7:
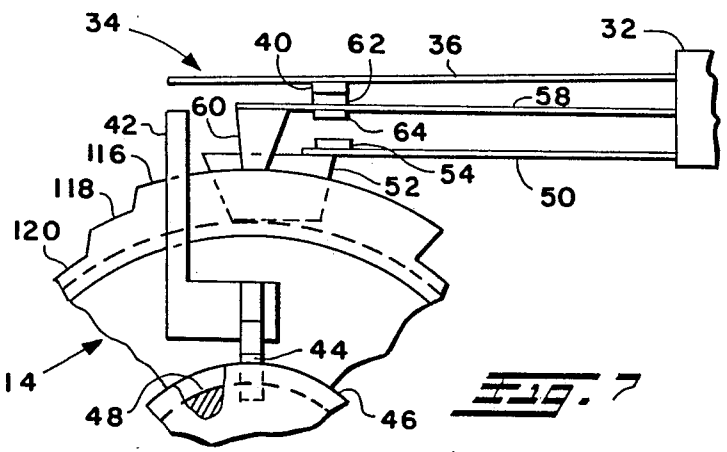
FIG. 7 is a view similar to FIG. 6 with the line switch actuator in the "ON" position and the cam maintaining the line switch closed.

Referring to FIG. 7, a changed condition of switch combination 34 is shown wherein the cam track 116 is maintained in the same position as shown in FIG. 6; however, the line switch actuator 42 has been dropped to the lower or "ON" position by moving the member 46 axially until the cam surface 44 has dropped onto the cam surface 48 (see FIG. 2). In the condition of FIG. 7, switch 34 has the line power contact blade 36 biased downwardly to close the contact sets 40, 62 maintaining power to the timing motor. With reference to FIGS. 6 and 7 it will be seen that irrespective of the position, e.g. "OFF" or "ON", of line switch actuators 46, 42 contacts 40, 62 are closed and power to the timing motor is continued; whereas, the lower set of contacts 64, 54 is broken.

Figure 8:
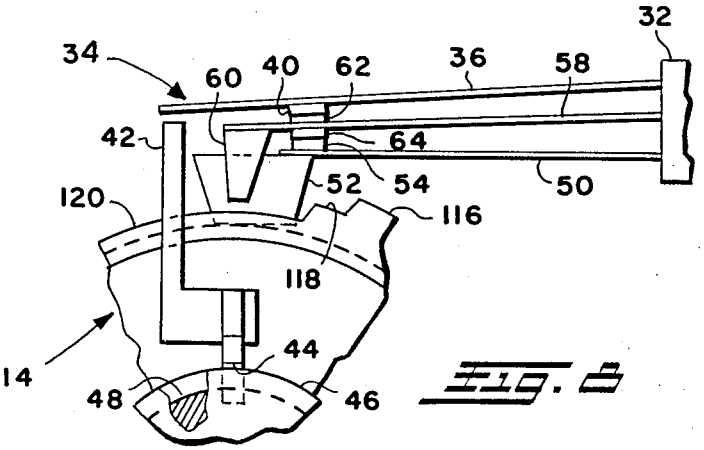
FIG. 8 is a view similar to FIG. 7 with the line switch actuator in the "ON" position and the cam rotated to a position closing the program switch.

Referring to FIG. 8, the line switch actuator member 42 is maintained in the lower position as described with respect to FIG. 7; however, the cam 14 has been rotated until the cam follower 60 is disposed above portion 120 of the cam track. In the cam track position shown in FIG. 8, blade 58 has dropped to close the lower contact set 64, 54 for providing power to the selected appliance functions, while the upper contact set 62, 40 is maintained closed for continuing power to the timing motor.

Figure 9:
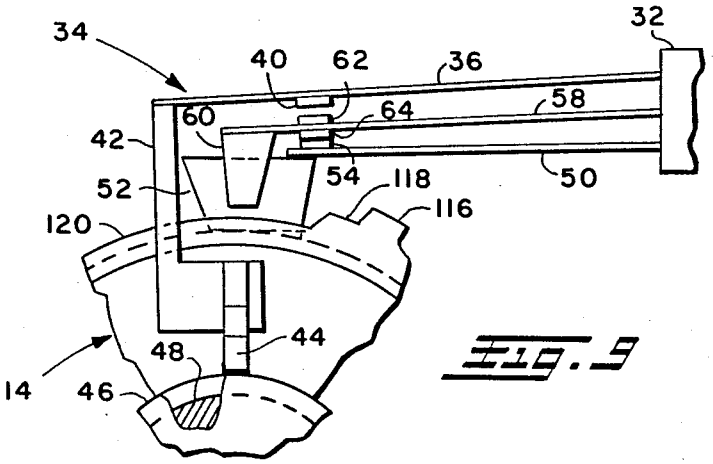
FIG. 9 is a view similar to FIG. 8 with the program cam in the same position as FIG. 8 but with the line switch actuator in the "OFF" position opening the line switch.

Referring to FIG. 9, the cam 14 and track portion 120 are maintained in the same position as illustrated in FIG. 8, the lower contact set 64, 54 is maintained closed; however, the line switch actuators 42, 46 have been moved to the "OFF" position and raising contact blade 36 and no power flows through the contacts 54, 64 because line power has been broken by the upper set of contacts.

Figure 10:
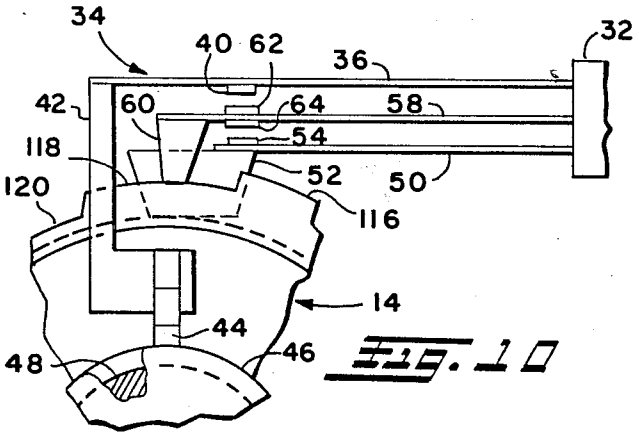
FIG. 10 is a view similar to FIG. 9 with the line switch actuator in the "OFF" position and the cam rotated to a position maintaining both line and program switches in the open circuit condition.

Referring to FIG. 10, the cam 14 has been rotated to a position wherein the intermediate level 118 of cam track is lifting the cam follower 60 and intermediate contact blade 58 to a open switch condition. The line switch actuator 42 has been moved to the raised or "OFF" position wherein blade 36 has been raised to break contacts 40, 62.

Figure 11:
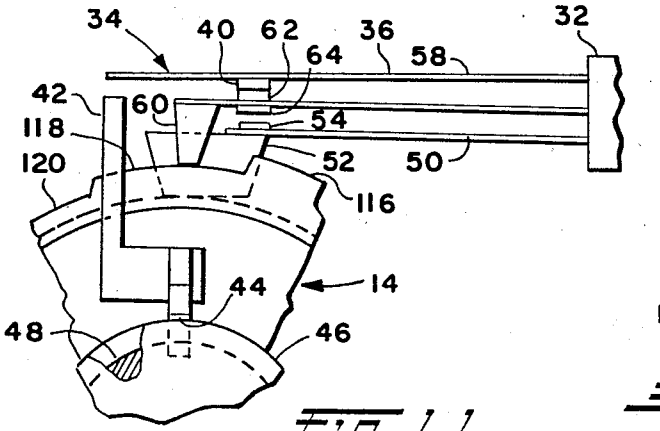
FIG. 11 is a view similar to FIG. 10 with the cam positioned in the same position as FIG. 10 but with the line switch actuator the "ON" position closing the line switch.

Referring to FIG. 11, the program cam track has been maintained in the same position as in FIG. 10; however, the line switch actuator member 42 has been dropped by axial movement of the member 46 to cause cam surface 44 to drop onto the cam 48 as shown in solid outline. With the line switch actuator in the position shown in FIG. 11, the self-bias of blade 36 has closed the contacts 40, 62 while the lower contact set is maintained broken for preventing current flow to the appliance functions. Thus, it will be seen that the intermediate cam track surface 118 is operative to effect opening and closing of the circuit to the timing motor.

Figure 12:
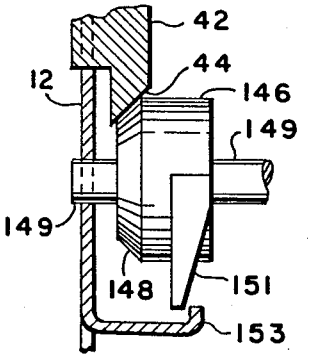
FIG. 12 is a view of an alternate embodiment of the line switch actuator cam illustrated in the "OFF" position.
Figure 13:
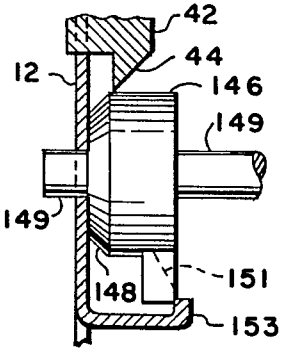
FIG. 13 is a view similar to FIG. 12 showing the line switch actuator in the "ON" position.

Referring to FIGS. 12 and 13, an alternative version of the line switch actuator is shown wherein the cam member 146 has a conical or chamfered auxilliary camming surface 148 thereon which contacts the vertical slider member 42 for actuating the upper contact blade 36. The cam member 146 is supported by shaft 149 which is journaled at one end in the deck plate 12 and has the opposite end shown truncated in FIGS. 12 and 13, but actually extending outwardly for user actuation via a knob (not shown).

Cam member 146 has provided thereon an auxiliary helical cam surface 151 which contacts a tab or lug 153 formed on the deck plate for automatically providing leftward axial movement of the cam member 146 upon rotation of the member 146 by shaft 149 due to the rotational coupling of the shaft 149 with cam drum 14. With reference to FIG. 12, the auxiliary cam 151 is shown in the "ON" position with the cam member 146 moved axially rightward by user movement of shaft 149 permitting rightward movement for camming slider 42 to be moved vertically downward for enabling moving the contact blade member 36 to move to the position contacting blade member 58 to close contact 40, 62.

Referring to FIG. 13, cam member 146 has been rotated by the cam drum 14 approximately one-quarter turn counterclockwise, as viewed from the right side in FIG. 12, to a position where auxiliary cam surface 151 has acted against the end of the lug 153 to cause diagonal sliding contact between cam surface 148 and surface 44 thereby raising the slider 42 and positioning the line switch blade 36 in the position breaking the circuit between contacts 40, 62. The version shown in FIGS. 12 and 13 thus incorporates an automatic appliance shut-off at the end of the program or where the user has manually rotated shaft 149 to position member 146 and surface 151 to the position shown in FIG. 13.

Figure 14:
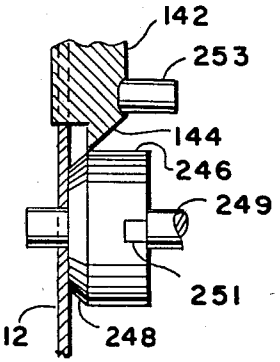
FIG. 14 is a view similar to FIG. 12 showing another embodiment of the line switch actuator cam.
Figure 15:
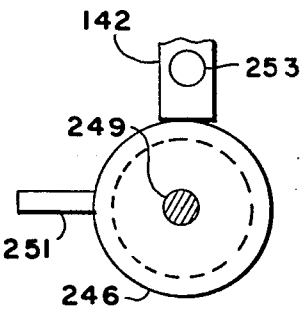
FIG. 15 is a right-hand view of the embodiment of FIG. 14 with the line actuator cam in the "ON" position.
Figure 16:
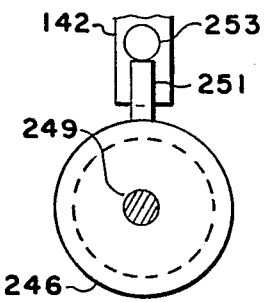
FIG. 16 is a view similar to FIG. 15 with the line switch actuator cam in the "OFF" position.

Referring to FIGS. 14 through 16, a further alternative version of the line switch actuator mechanism is illustrated where a cam member 246 has shaft 249 extending in opposite directions therefrom, with one end journaled in plate 12 and the other end in the direction opposite the plate 12 for user actuation, but shown truncated. The member 246 has a conical or chamfered auxiliary cam surface 248 provided on the axial end thereof adjacent plate 12 and a lug 251 extending radially outwardly from the outer diameter thereof. The line switch actuator slider 142 has provided thereon a projection 253 which has a generally cylindrical configuration to provide a camming action upon rotation of the cam member 246 to a position such that the end of the projection 251 engages the cylindrical surface of the member 253. Rotation of the member 246 by user rotation of shaft 249 one-quarter turn counterclockwise from the FIG. 15 position as shown in FIG. 16 raises slider 142 to its vertically upward position thereby raising line switch contact blade member 36 to the "OFF" position.

The present invention thus provides a programmer/-timer for an appliance wherein the line power switch for controlling power to the timer motor for advancing the program cam drum and all of the machine functions is combined with a program switch for controlling selected machine functions in response to cam drum rotation. A user operated actuator permits the appliance user to selectively open and close the line power switch during operation of the machine program.

The present invention provides for a single switch start which combines line power switching with selected program switching in response to a follower on a single program cam track. In one embodiment, the program cam maintains power to the timing motor to advance the cam when the user opens the line power switch with the program cam in certain positions to stop the main appliance functions. Continued rotation of the cam by the advance mechanism advances the cam to provide certain function positions desirable for restart upon the user closing the line power switch.

Although the present invention has hereinabove been described with respect to the illustrated embodiments, it will be understood that the invention is capable of modification and variation and is limited only by the following claims.

We claim:

1. A combination electrical programmer timer and line switch assembly for an appliance comprising:

(a) housing means;

(b) a program cam mounted for rotary movement on said housing means;

(c) timing motor means associated with said housing means and operable upon energization to effect said movement of said program cam;

(d) a first movable line switch contact blade mounted on said housing means for connection to one side of a power line;

(e) actuator means movably mounted on said housing means and including auxiliary cam means contacting a movable member operable upon user manual movement to move said movable member for moving said movable first contact blade between a first (low) and second (high) position;

(f) a stationary contact blade mounted on said housing means for series connection with certain appliance functions;

(g) an active program switch contact blade disposed on said housing means between said first movable line contact blade and said stationary blade, said program switch blade including a cam follower contacting said program cam, said program switch blade series connected with said motor means for series connection with all of said appliance functions, wherein said line contact blade in said high position prevents energization of said motor for any position of said cam follower on said programmer cam and in said first (low) position, maintains said motor energized for all positions of said cam follower on said program cam.

2. The combination defined in claim 1, wherein said actuator is user movable between a first position lowering said line switch blade toward said program cam and a second position raising said line switch blade further from said program cam.

3. The combination defined in claim 1, wherein said actuator means includes a cam member movable in an axial direction with respect to rotation of said program cam and a second member movable in a radial direction for contacting said line contact blade.

4. The combination defined in claim 1, wherein said actuator means is operable to move said line switch contact blade between a first (low) position to a second (high) position, said actuator means operable in said first position to maintain said line switch contact blade in closed circuit contact with said program contact blade energizing said motor means for all positions of the program cam and operable in said second position to maintain said line switch contact blade in open circuit position with respect to said active program blade de-energizing said motor means for all positions of said program cam.

5. The combination defined in claim 1, wherein said actuator means is movable in response to user actuation, between a first (low) position and a second (high) position, wherein said line switch contact blade in said first position maintains a closed circuit with said active program blade for all positions of said cam and a second (high) position wherein said active blade in said second position opens the circuit with said line switch contact blade for certain positions of said program cam, and is in open circuit with said line switch contact blade for other positions of said program cam, said actuator means in said first (low) position maintains said active program contact blade in closed circuit relationship with said line switch contact blade and said timing motor means energized for all positions of said program cam.

6. The combination defined in claim 1, wherein said actuator means includes selector cam means operable drum user rotation to effect movement of said actuator means between said first (low) and said second (high) position.

7. The combination defined in claim 1, wherein said program cam is operative in certain selected positions to maintain said program contact blade in closed circuit contact with said line contact blade for both of said high and low positions of said actuator means.

* * * * *